US010808482B2

(12) United States Patent
Hess et al.

(10) Patent No.: US 10,808,482 B2
(45) Date of Patent: Oct. 20, 2020

(54) ESTABLISHING COMMUNICATION DOWNHOLE BETWEEN WELLBORES

(71) Applicant: Halliburton Energy Services, Inc., Houston, TX (US)

(72) Inventors: Joseph E. Hess, Richmond, TX (US); Thomas E. Burky, Alvarado, TX (US); Andrew J. Cuthbert, Spring, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 183 days.

(21) Appl. No.: 16/112,028

(22) Filed: Aug. 24, 2018

(65) Prior Publication Data

US 2018/0363400 A1 Dec. 20, 2018

Related U.S. Application Data

(62) Division of application No. 15/107,036, filed as application No. PCT/US2014/038520 on May 17, 2014, now Pat. No. 10,605,026.

(51) Int. Cl.

| | |
|---|---|
| ***E21B 29/02*** | (2006.01) |
| ***E21B 43/119*** | (2006.01) |
| ***E21B 21/08*** | (2006.01) |

(52) U.S. Cl.

CPC ..... *E21B 29/02* (2013.01); *E21B 21/08* (2013.01); *E21B 43/119* (2013.01)

(58) Field of Classification Search

CPC ..... E21B 29/02; E21B 29/08; E21B 43/119; E21B 43/117; E21B 43/17; F42B 1/00; F42D 1/02; F42D 1/18

USPC ..... 299/13; 102/305–310

See application file for complete search history.

(56) References Cited

U.S. PATENT DOCUMENTS

| | | | | |
|---|---|---|---|---|
| 2,630,182 A | | 3/1953 | Klotz, Jr. et al. | |
| 2,775,940 A | | 1/1957 | Klotz, Jr. | |
| 2,998,068 A | | 8/1961 | True | |
| 3,091,177 A | * | 5/1963 | Grebe | F42B 1/00 102/313 |
| 3,097,693 A | | 7/1963 | Terrel | |

(Continued)

FOREIGN PATENT DOCUMENTS

WO 2015178875 A1 11/2015

OTHER PUBLICATIONS

International Search Report and the Written Opinion for International Application No. PCT/US2014/038520 dated Feb. 16, 2015, 14 pages.

*Primary Examiner* — Kenneth L Thompson
(74) *Attorney, Agent, or Firm* — Chamberlain Hrdlicka

(57) ABSTRACT

A method of establishing fluid communication between wellbores can include forming a flow path from one wellbore to another wellbore, a flow area of the flow path increasing in a direction from the first wellbore toward the second wellbore. An explosive assembly for use in a well can include an explosive device having multiple explosive charges, the explosive charges producing longitudinal shock waves that collide with each other and result in a laterally directed shock wave, and a shield that focuses the laterally directed shock wave into a predetermined angular range of less than 360 degrees. A method of establishing fluid communication between wellbores can include forming a flow path from one wellbore to another wellbore, the flow path intersecting an uncased portion of the second wellbore.

5 Claims, 7 Drawing Sheets

(56) References Cited

U.S. PATENT DOCUMENTS

| | | | | |
|---|---|---|---|---|
| 3,224,506 | A | 12/1965 | Huitt et al. | |
| 3,280,909 | A | 10/1966 | Closmann et al. | |
| 3,627,044 | A | 12/1971 | Dunlap | |
| 4,019,578 | A | 4/1977 | Terry et al. | |
| 4,248,303 | A | 2/1981 | Charpentier | |
| 4,378,844 | A | 4/1983 | Parrish et al. | |
| 4,436,154 | A | 3/1984 | Vann et al. | |
| 4,651,824 | A | 3/1987 | Gradle | |
| 5,780,764 | A | 7/1998 | Welch et al. | |
| 6,622,632 | B1 * | 9/2003 | Spivak | F42B 12/204 102/305 |
| 7,104,326 | B2 | 9/2006 | Grattan et al. | |
| 7,624,682 | B2 * | 12/2009 | Lloyd | F42B 12/06 102/497 |
| 7,707,939 | B2 * | 5/2010 | Brent | F42D 3/04 102/312 |
| 9,476,682 | B1 | 10/2016 | Powell et al. | |
| 9,658,359 | B2 | 5/2017 | Dirksen et al. | |
| 10,094,190 | B2 * | 10/2018 | Grattan | E21B 29/02 |
| 10,605,026 | B2 * | 3/2020 | Hess | E21B 21/08 |
| 2001/0045280 | A1 | 11/2001 | Longbottom et al. | |
| 2003/0075328 | A1 | 4/2003 | Challacombe | |
| 2005/0126783 | A1 | 6/2005 | Grattan et al. | |
| 2010/0181114 | A1 | 7/2010 | Best et al. | |
| 2013/0269935 | A1 | 10/2013 | Cao et al. | |
| 2014/0076554 | A1 | 3/2014 | Thonpson et al. | |
| 2014/0096954 | A1 | 4/2014 | Hocking | |
| 2014/0144623 | A1 | 5/2014 | Pyecroft et al. | |
| 2015/0021029 | A1 | 1/2015 | Abrant et al. | |
| 2016/0209196 | A1 * | 7/2016 | Phillips | F42D 1/18 |
| 2016/0230526 | A1 | 8/2016 | Crews et al. | |
| 2016/0281480 | A1 | 9/2016 | Pyecroft | |
| 2018/0291688 | A1 | 10/2018 | Hess et al. | |

* cited by examiner

ESTABLISHING COMMUNICATION DOWNHOLE BETWEEN WELLBORES

PRIORITY APPLICATION

This application is a divisional application of co-pending application is a U.S. patent application Ser. No. 15/107,036, filed Jun. 21, 2016, which is a National Stage Filing under 35 U.S.C. 371 from International Application No. PCT/US2014/038520, filed 17 May 2014, and published as WO 2015/178875 A1 on 26 Nov. 2015, which applications and publication are incorporated herein by reference in their entirety.

TECHNICAL FIELD

This disclosure relates generally to operations performed and equipment utilized in conjunction with subterranean wells and, in one example described below, more particularly provides for establishing communication downhole between wellbores.

BACKGROUND

A relief well can be drilled close to a target well, for example, in order to mitigate an uncontrolled flow of formation fluid from the target well. In some cases, fluids (such as, kill weight mud, treatment fluid, etc.) and/or cement are pumped from the relief well into the target well. Therefore, it will be readily appreciated that it would be desirable to provide to the art equipment and techniques for quickly establishing a relatively large flow path between wellbores downhole.

DETAILED DESCRIPTION

Figure 1:
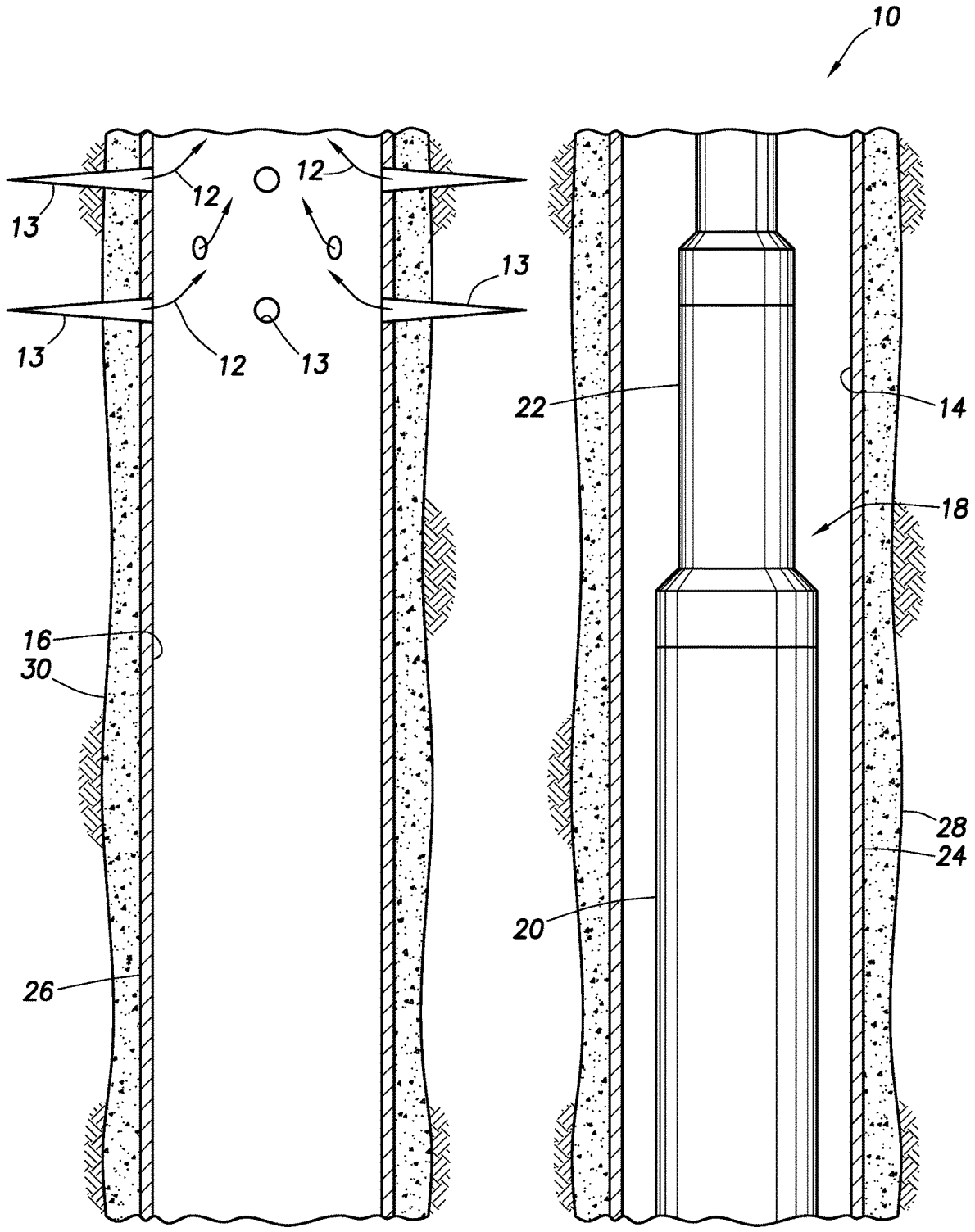
FIG. 1 is a representative partially cross-sectional view of an example of a well system and associated method which can embody principles of this disclosure, the system and method being depicted after an explosive assembly has been positioned in a wellbore drilled proximate another wellbore.

Representatively illustrated in FIG. 1 is an example of a system 10 for use with a subterranean well, and an associated method, which system and method can embody principles of this disclosure. However, it should be clearly understood that the system 10 and method are merely one example of an application of the principles of this disclosure in practice, and a wide variety of other examples are possible. Therefore, the scope of this disclosure is not limited at all to the details of the system 10 and method described herein and/or depicted in the drawings.

In the FIG. 1 example, a wellbore 14 has been drilled so that at least a portion of the wellbore 14 is near to another, previously drilled wellbore 16. An uncontrolled flow of formation fluid 12 is entering the wellbore 16.

The fluid 12 enters the wellbore 16 via perforations 13. However, in other examples, the fluid 12 could enter the wellbore 16 via a collapsed or parted casing section, an open hole portion of the wellbore or at another location. Thus, the scope of this disclosure is not limited to any particular cause or location of fluid entry into the wellbore 16.

It is desired to establish fluid communication between the wellbores 14, 16, so that flow of the formation fluid 12 into the wellbore 16 can be controlled, the wellbore 16 can be plugged, and/or so that flow of the fluid 12 can be diverted to the wellbore 14. The scope of this disclosure is not limited to any particular purpose for establishing communication between the wellbores 14, 16.

To establish fluid communication between the wellbores 14, 16, an explosive assembly 18 is positioned in the wellbore 14. The explosive assembly 18 may be conveyed through the wellbore 14 by means of a wireline, a slickline, coiled tubing, jointed tubing, a tractor or by any other type of conveyance, and/or by gravity.

In the example depicted in FIG. 1, the explosive assembly 18 includes an explosive device 20 and a firing head 22 for causing detonation of the explosive device when desired. Additional or different components (such as, an orienting device described more fully below, see FIGS. 6-8) can be included in the explosive assembly 18, so it should be clearly understood that the scope of this disclosure is not limited to any particular type, number or combination of components in the explosive assembly.

The wellbores 14, 16 depicted in FIG. 1 are lined with respective casings 24, 26 and cement 28, 30. However, in other examples, either or both of the wellbores 14, 16 could be uncased or open hole at portions thereof where communication is to be established between the wellbores.

As used herein, the term "casing" refers to a protective wellbore lining. Casing can be tubulars of the type known to those skilled in the art as casing, liner or tubing. Casing can be jointed or continuous. Casing can be pre-formed or formed in-situ. Thus, the scope of this disclosure is not limited to use of any particular type of casing.

As used herein, the term "cement" refers to a hardenable substance used to plug a wellbore or seal off an annular space, for example, between a tubular and a wellbore wall, or between two tubulars. Cement is not necessarily cementitious, since epoxies and other hardenable polymers can be used as cement. The scope of this disclosure is not limited to use of any particular type of cement.

Since it is desired to establish fluid communication with the wellbore 16, that wellbore may be known to those skilled in the art as a "target" wellbore. Since the wellbore 14 is used to establish such communication, that wellbore may be known to those skilled in the art as a "relief" wellbore. However, it is not necessary for the wellbore 14 to be a relief wellbore, or for the wellbore 16 to be a target wellbore, in keeping with the principles of this disclosure.

Figure 2:
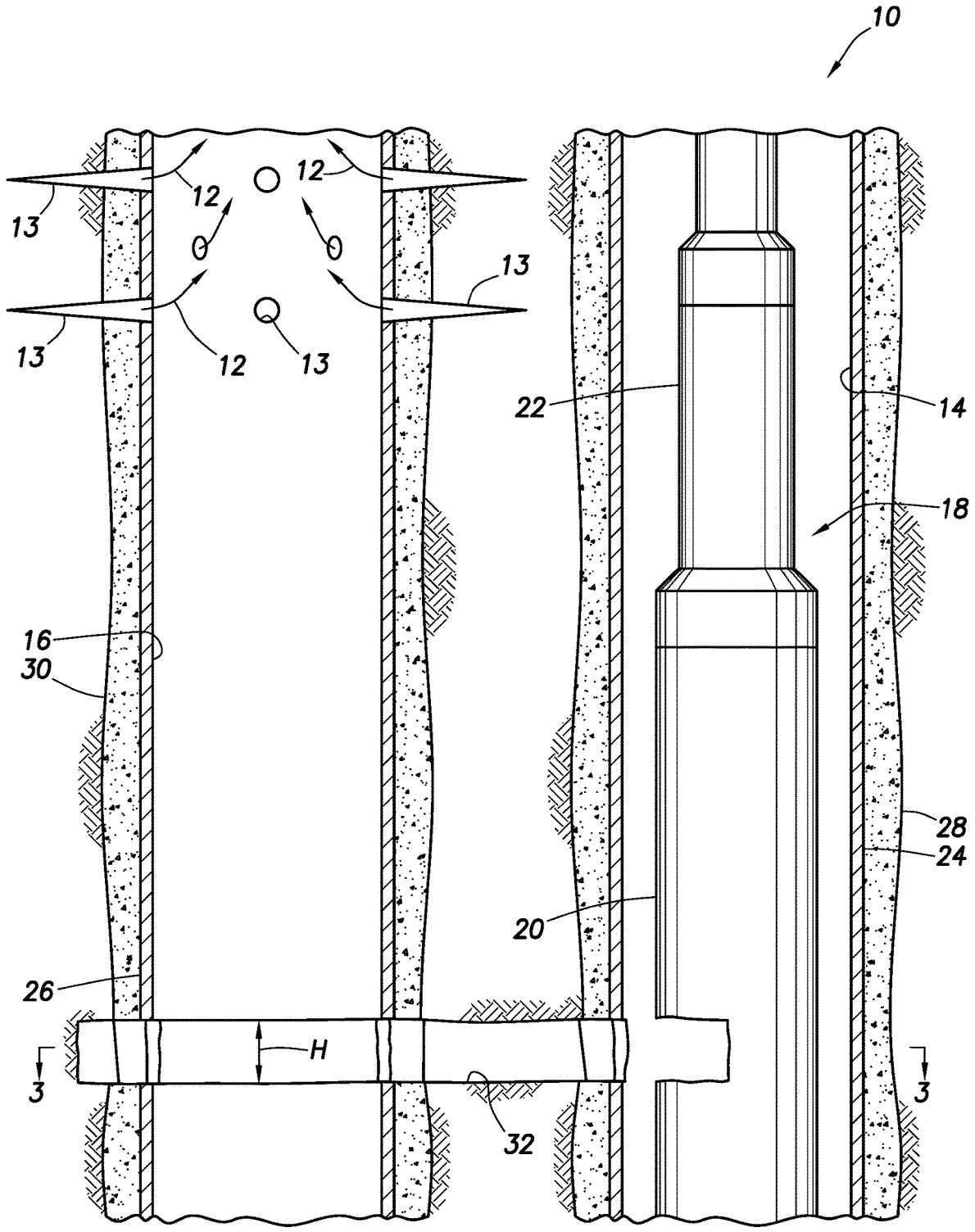
FIG. 2 is a representative partially cross-sectional view of the system and method, after the explosive assembly has been detonated, thereby forming a flow path between the wellbores.

FIG. 2 is a representative partially cross-sectional view of the system 10 and method, after the explosive assembly 18 has been detonated, thereby forming a flow path 32 between the wellbores 14, 16. The flow path 32 provides for fluid communication between the wellbores 14, 16 with a relatively large flow area. The large flow area of the flow path 32 allows fluid and other substances to be readily flowed between the wellbores 14, 16.

In this example, the flow path 32 extends through one side of the casing 24 and cement 28, and completely through the casing 26 and cement 30. In other examples, the casing 26 and cement 30 may not be completely severed by detonation of the explosive device 20.

As depicted in FIG. 2, the flow path 32 has a relatively uniform height H. However, it is expected that, due to the violent nature of explosions, the flow path 32 height H, width, etc., will be somewhat erratic. Thus, the flow path 32 configurations and shapes depicted in the drawings are for convenience of illustration and to facilitate description herein, but it should be clearly understood that the scope of this disclosure is not limited to any particular flow path configurations or shapes.

Figure 3:
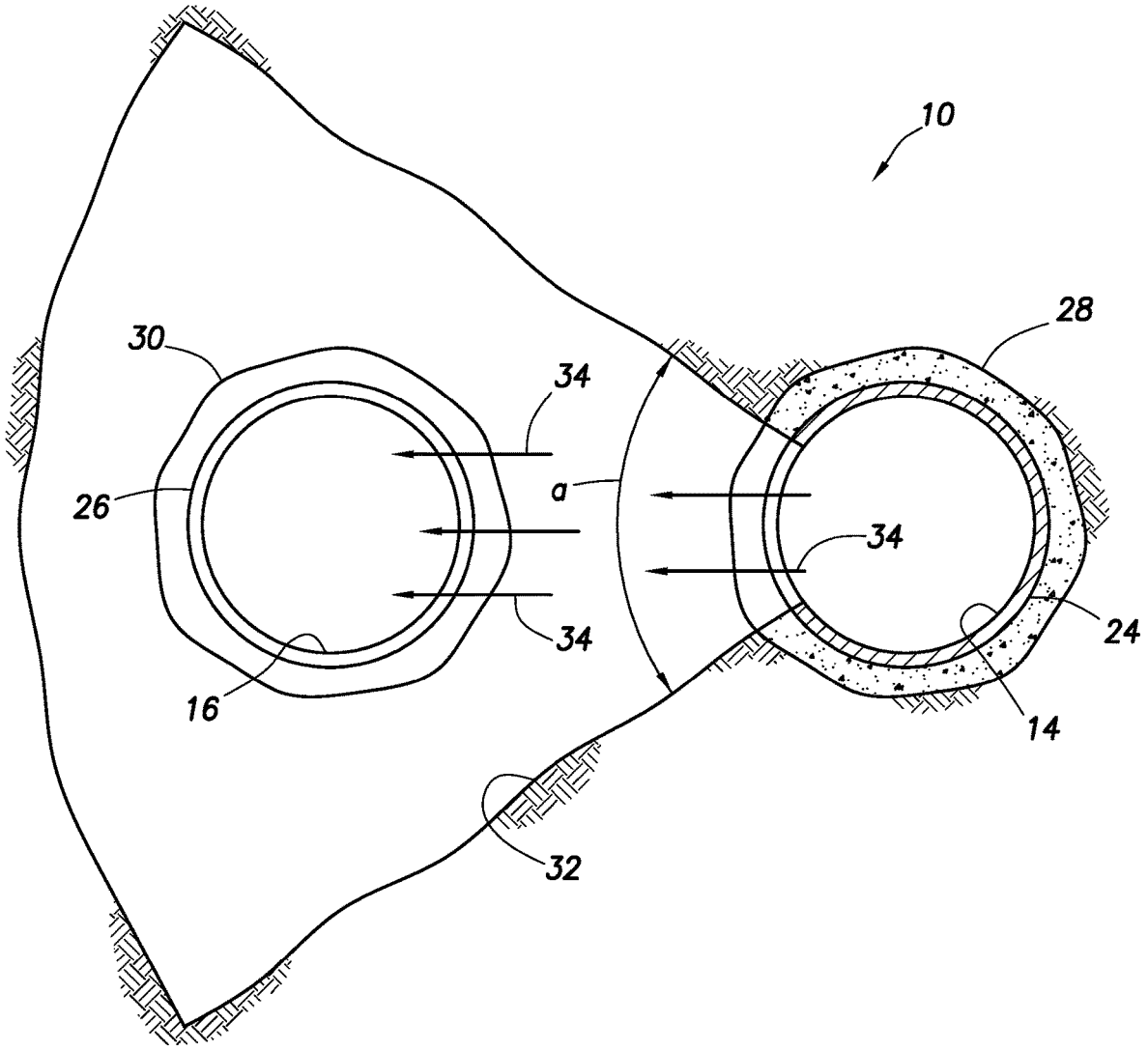
FIG. 3 is a representative cross-sectional view of the system and method, taken along line 3-3 of FIG. 2.

FIG. 3 is a representative cross-sectional view of the system 10 and method, taken along line 3-3 of FIG. 2, after retrieval of the explosive assembly 18 from the wellbore 14. In this view, it can be seen that the flow path 32 in this example is shaped similar to an angular sector of a circle, with an angle a between lateral sides of the flow path. However, it is not necessary in keeping with the principles of this disclosure for the flow path 32 to have this shape.

The flow path 32 allows a substance 34 (such as, a kill weight mud, a treatment fluid, cement, etc.) to be readily flowed from the wellbore 14 to the wellbore 16. In some circumstances (such as, diversion of the fluid 12 (see FIGS. 1 & 2) into the wellbore 14), flow in an opposite direction through the flow path 32 may be desired. Therefore, the scope of this disclosure is not limited to any particular direction of flow through the flow path 32.

The angle a can be selected to provide a sufficiently large flow area of the flow path 32, and to ensure that the flow path intersects the wellbore 16. To ensure that relatively minor inaccuracies in rotationally orienting the explosive device 20 (see FIGS. 1 & 2) in the wellbore 14 do not result in the flow path 32 "missing" the wellbore 16, it is envisioned that a minimum angle a of about 20 degrees could be used. Of course, other angles may be used within the scope of this disclosure.

Figure 4:
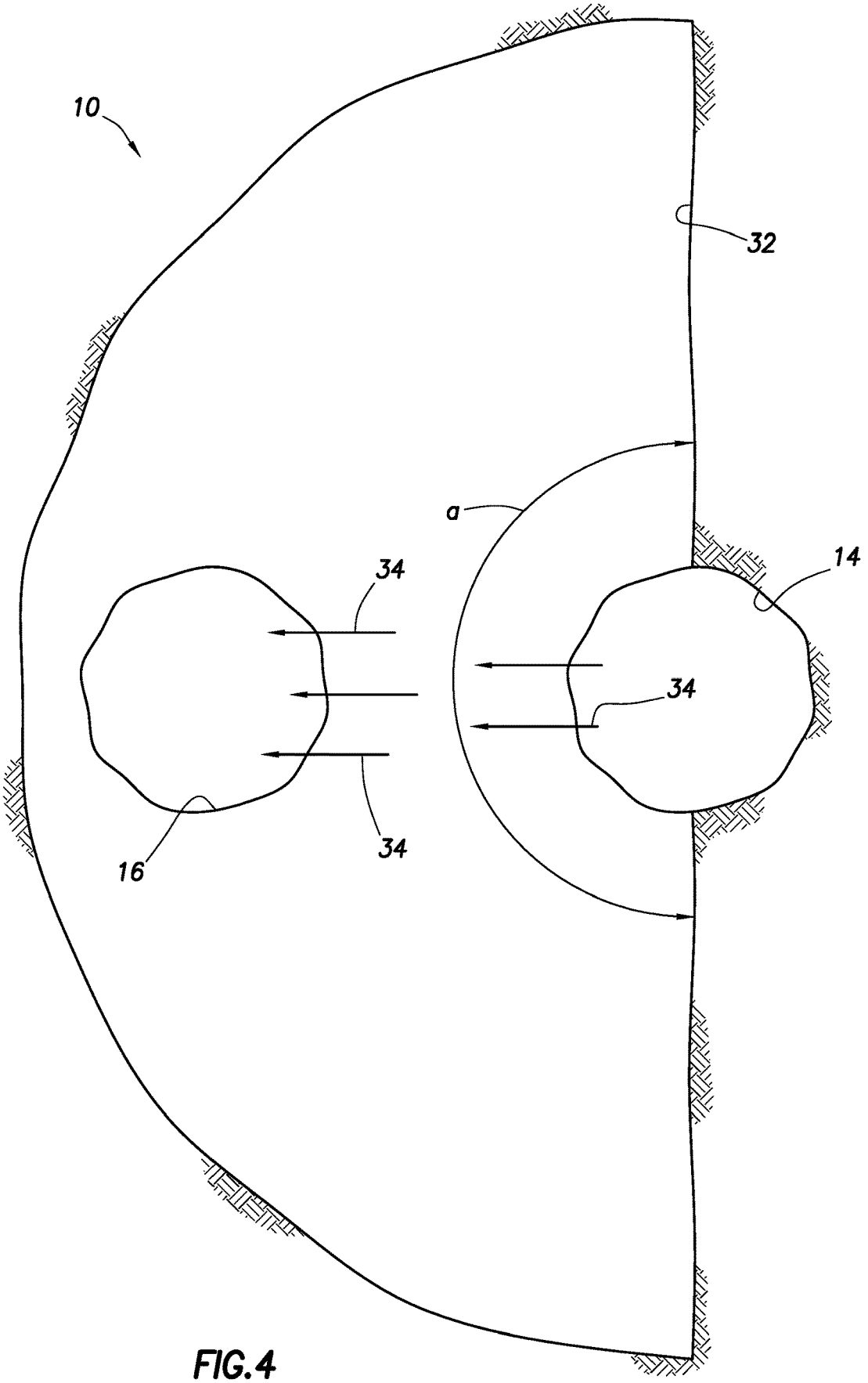
FIG. 4 is a representative cross-sectional view of the system and method, depicting an open hole example.

FIG. 4 is a representative cross-sectional view of the system 10 and method, depicting an open hole example. In this example, the flow path 32 is formed from an uncased portion of the wellbore 14 to an uncased portion of the wellbore 16. In addition, the FIG. 4 example differs from the FIG. 3 example, in that the angle a is about 180 degrees.

A relatively large angle a allows for significant variability in the rotational orientation of the explosive device 20 (see FIGS. 1 & 2) in the wellbore 14, and also provides for a large increase in the flow area of the flow path 32 in a direction toward the wellbore 16. However, as the angle a increases, explosive energy density decreases, and so a lateral extent of the flow path 32 toward the wellbore 16 also decreases.

For each practical application, and guided by experimental results for specific explosive assemblies and wellbore configurations, the angle a can be selected to produce certain desired results. It is contemplated that, for most practical applications, the angle a should be in a range of about 20 degrees to about 180 degrees. If rotational orientation of the explosive device 20 relative to the wellbore 16 is expected to be less accurate, or if a position of the wellbore 16 relative to the wellbore 14 is less accurately known, then an angular range of about 90 degrees to about 180 degrees may be more preferable.

Figure 5:
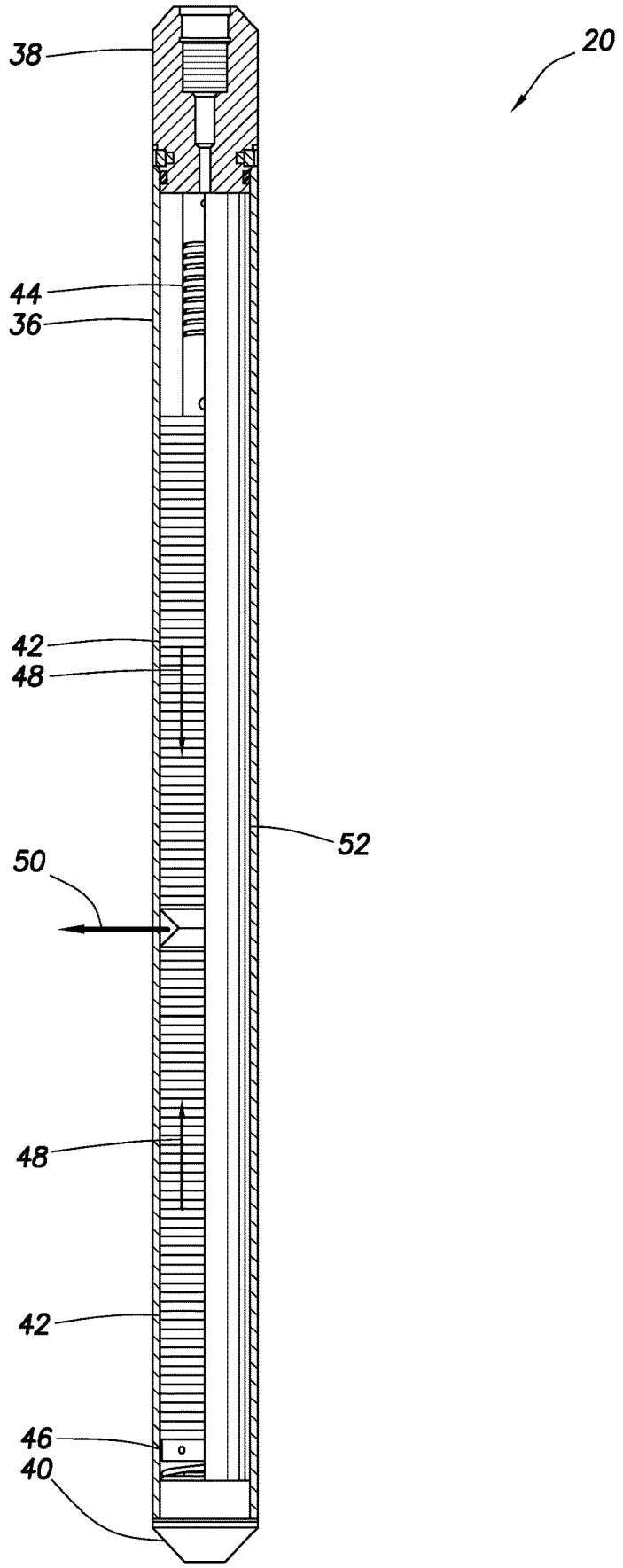
FIG. 5 is a representative partially cross-sectional view of an example of an explosive device of the explosive assembly.

FIG. 5 is a representative partially cross-sectional view of an example of the explosive device 20 of the explosive assembly 18. The explosive device 20 depicted in FIG. 5 may be used in the system 10 and method of FIGS. 1 & 2, or it may be used in other systems and methods.

In this example, the explosive device 20 includes an outer housing 36, an upper connector 38 for connecting to the firing head 22 (see FIGS. 1 & 2), and a lower plug 40. Multiple explosive charges 42 are arranged in the housing 36 between upper and lower retainers 44, 46.

The explosive charges 42 are arranged and configured, so that, when detonated, the charges produce respective longitudinally directed shock waves 48. These shock waves 48 collide with each other at or near a middle of the explosive device 20, and thereby produce a laterally directed shock wave 50.

As thus far described, the explosive device 20 is substantially similar to a Drill Collar Severing Tool marketed by Jet Research Center of Alvarado, Tex. USA, a division of Halliburton Energy Services, Inc. However, since the Drill Collar Severing Tool is designed to completely sever drill collars and other tubulars within a wellbore, the lateral shock wave produced by the Drill Collar Severing Tool emanates a full 360 degrees from the tool.

In contrast, the explosive device 20 depicted in FIG. 5 includes a shield 52 that wraps partially circumferentially about the charges 42 and, thus, limits a circumferential extent of the lateral shock wave 50. In addition, by limiting the circumferential extent of the lateral shock wave 50, the shield 52 focuses the lateral shock wave 50, thereby enabling the shock wave to penetrate further toward (and, in some cases, past) the wellbore 16.

In the FIG. 5 example, the shield 52 extends about 180 degrees about the charges 42, thereby producing the lateral shock wave 50 that emanates about 180 degrees from the explosive device 20. Such a configuration can produce the flow path 32 example as depicted in FIG. 4. By wrapping the shield 52 further about the charges 42, a narrower flow path 32 can be produced (as in the example of FIG. 3).

The shield 52 can be made of any suitable material. For example, the shield 52 may be constructed from a sheet of steel having an appropriate width so that, when rolled to an appropriate radius, the shield will wrap about the charges 42 to a desired extent. As an alternative, the shield 52 could be constructed from a longitudinally sliced tubular. The shield 52 can have a suitable thickness so that, when the charges 42 are detonated, the shield limits the circumferential extent of the lateral shock wave 50, even if the shield does not necessarily "survive" the detonation.

In the example depicted in FIG. 5, the shield 52 appears to be relatively thin, and is positioned in the housing 36. However, it is contemplated that, in order for the shield 52 to appropriately block and focus shock waves produced by detonation of the charges 42, the shield should have a substantial mass and thickness (e.g., equal to a diameter of the housing 36). Accordingly, the shield 52 could be positioned external to the housing 36, or the shield could be part of the housing.

Figure 7:
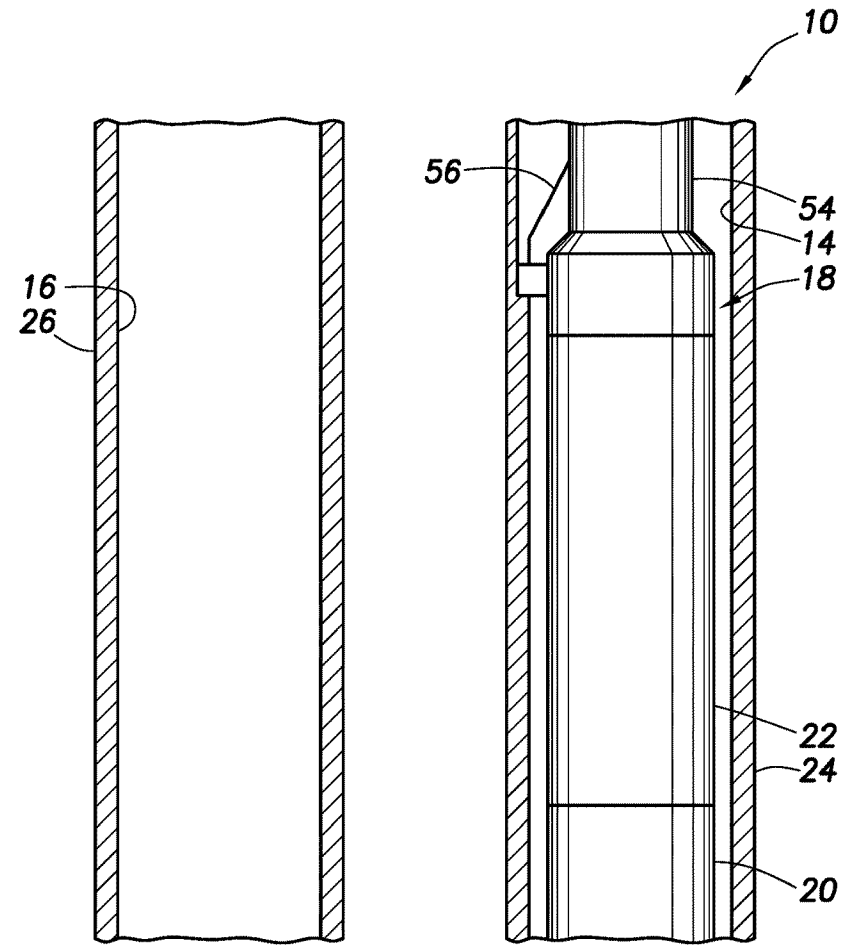
FIGS. 6-8 are representative partially cross-sectional views of additional examples of the system and method, in which an orienting device is used to rotationally orient the explosive assembly.
Figure 6:
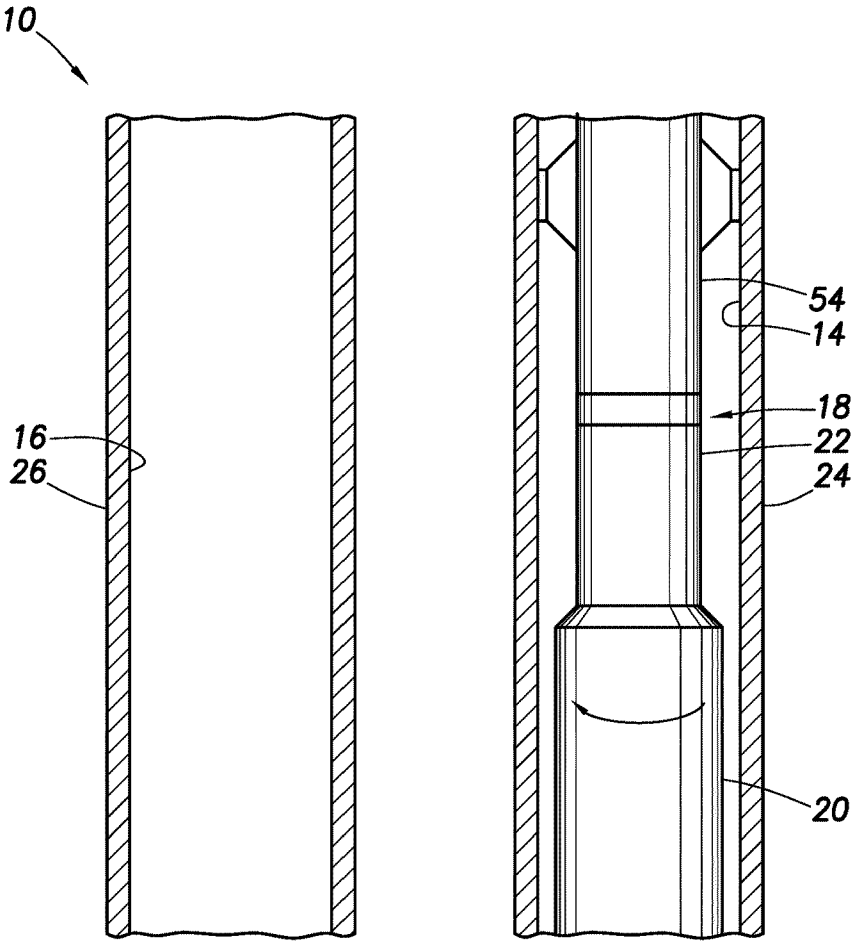
Figure 8:
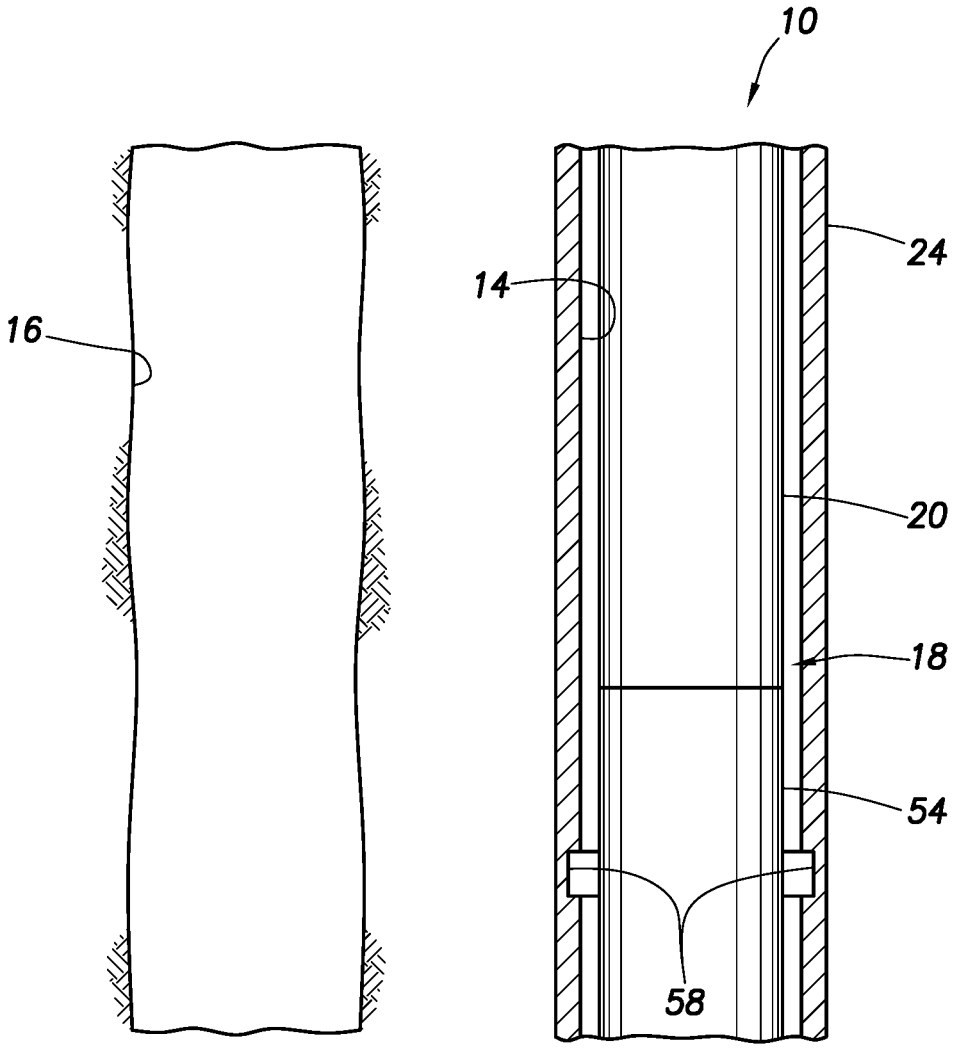

FIGS. 6-8 are representative partially cross-sectional views of additional examples of the system 10 and method, in which an orienting device 54 is used to rotationally orient the explosive assembly 18. Only the two wellbores 14, 16 and casings 24, 26 (if the respective wellbore portion is cased) are depicted in FIGS. 6-8, for clarity of illustration.

In the FIG. 6 example, the orienting device 54 is capable of rotating the explosive device 20, so that it will form the flow path 32 in a direction toward the wellbore 16. If the position of the wellbore 16 relative to the wellbore 14 is known (e.g., from a prior or concurrent survey), then the orienting device 54 may be equipped with an orientation sensor (such as, a gyroscope) to determine how much to rotate the explosive device 20 so that it is facing toward the wellbore 16. If the position of the wellbore 16 relative to the wellbore 14 is not accurately known, then the orienting device 54 may be equipped with a sensor (such as, a magnetic field sensor) that rotates with the explosive device 20 to determine when it is facing toward the wellbore 16.

In the FIG. 7 example, the orientation device 54 includes a laterally outwardly extending dog or lug that engages a profile 56 (such as, a "muleshoe" profile) in the casing 24. Prior to running the explosive assembly 18, an orientation of the profile 56 relative to the wellbore 16 is known (for example, by survey when the casing 24 is installed, or thereafter), and a rotational orientation of the orientation device 54 relative to the explosive device 20 is correspondingly set, so that, when the orientation device engages the profile, the explosive device will face toward the wellbore 16.

The FIG. 8 example is similar in some respects to the FIG. 7 example. As depicted in FIG. 8, the wellbore 16 is uncased or open hole at a portion thereof near the wellbore 14, but this portion of the wellbore 16 could be cased in other examples.

In the FIG. 8 example, the orientation device 54 is connected below the explosive device 20 and includes multiple latch members that engage corresponding multiple latch profiles 58 in the casing 24. The latch profiles 58 are arranged so that the orientation device 54 can only engage the profiles when the orientation device is in a particular rotational orientation relative to the casing 24.

Engagement of the latch members with the latch profiles 58 both rotationally orients the explosive assembly 18 relative to the casing 14 (and the casing 16), and secures the explosive assembly in the casing 14. As with the FIG. 7 example, an orientation of the profiles 58 relative to the wellbore 16 is known (for example, by survey when the casing 24 is installed, or thereafter), and a rotational orientation of the orientation device 54 relative to the explosive device 20 is correspondingly set, so that, when the orientation device engages the profiles, the explosive device will face toward the wellbore 16.

It can now be fully appreciated that the above disclosure provides significant advances to the art of establishing communication between wellbores downhole. In examples described above, the flow path 32 formed by the explosive assembly 18 is relatively large and the method of forming the flow path is relatively quick, so that fluids and other substances can be rapidly and conveniently flowed between the wellbores 14, 16.

A method of establishing fluid communication between first and second wellbores 14, 16 is provided to the art by the above disclosure. In one example, the method can include: forming a flow path 32 from the first wellbore 14 to the second wellbore 16, with a flow area of the flow path 32 increasing in a direction from the first wellbore 14 toward the second wellbore 16.

The forming step can comprise detonating an explosive device 20 in the first wellbore 14. The detonating step may comprise multiple longitudinal shock waves 48 colliding and producing a lateral shock wave 50 that forms the flow path 32.

The forming step may include completely severing a casing 26 which lines the second wellbore 16.

The forming step may include forming the flow path 32 from a cased portion of the first wellbore 14 to an uncased portion of the second wellbore 16, or from a cased portion of the first wellbore 14 to a cased portion of the second wellbore 16, or from an uncased portion of the first wellbore 14 to an uncased portion of the second wellbore 16.

An explosive assembly 18 for use in a subterranean well is also described above. In one example, the explosive assembly 18 can comprise an explosive device 20 including multiple explosive charges 42, the explosive charges 42 producing longitudinal shock waves 48 that collide with each other and result in a laterally directed shock wave 50, and a shield 52 that focuses the laterally directed shock wave 50 into a predetermined angular range of less than 360 degrees about the explosive device 20.

The angular range may be at least about 20 degrees, and may be at most about 180 degrees.

The shield 52 can comprise a longitudinally extending member which wraps partially circumferentially about the explosive charges 42.

An orienting device 54 may be connected to the explosive device 20.

Another method of establishing fluid communication between first and second wellbores 14, 16 can comprise forming a flow path 32 from the first wellbore 14 to the second wellbore 16, with the flow path 32 intersecting an uncased portion of the second wellbore 16.

Although various examples have been described above, with each example having certain features, it should be understood that it is not necessary for a particular feature of one example to be used exclusively with that example. Instead, any of the features described above and/or depicted in the drawings can be combined with any of the examples, in addition to or in substitution for any of the other features of those examples. One example's features are not mutually exclusive to another example's features. Instead, the scope of this disclosure encompasses any combination of any of the features.

Although each example described above includes a certain combination of features, it should be understood that it is not necessary for all features of an example to be used. Instead, any of the features described above can be used, without any other particular feature or features also being used.

It should be understood that the various embodiments described herein may be utilized in various orientations, such as inclined, inverted, horizontal, vertical, etc., and in various configurations, without departing from the principles of this disclosure. The embodiments are described merely as examples of useful applications of the principles of the disclosure, which is not limited to any specific details of these embodiments.

In the above description of the representative examples, directional terms (such as "above," "below," "upper," "lower," etc.) are used for convenience in referring to the accompanying drawings. However, it should be clearly understood that the scope of this disclosure is not limited to any particular directions described herein.

The terms "including," "includes," "comprising," "comprises," and similar terms are used in a non-limiting sense in this specification. For example, if a system, method, apparatus, device, etc., is described as "including" a certain feature or element, the system, method, apparatus, device, etc., can include that feature or element, and can also include other features or elements. Similarly, the term "comprises" is considered to mean "comprises, but is not limited to."

Of course, a person skilled in the art would, upon a careful consideration of the above description of representative embodiments of the disclosure, readily appreciate that many modifications, additions, substitutions, deletions, and other changes may be made to the specific embodiments, and such changes are contemplated by the principles of this disclosure. For example, structures disclosed as being separately formed can, in other examples, be integrally formed and vice versa. Accordingly, the foregoing detailed description is to be clearly understood as being given by way of illustration and example only, the spirit and scope of the invention being limited solely by the appended claims and their equivalents.

What is claimed is:

1. An explosive assembly for use in a subterranean well, the explosive assembly comprising:

an explosive device including multiple explosive charges, wherein the explosive charges produce longitudinal shock waves that collide with each other and result in a laterally directed shock wave;

a shield that focuses the laterally directed shock wave into a predetermined angular range of less than 360 degrees about the explosive device.

2. The explosive assembly of claim 1, wherein an orienting device is connected to the explosive device.

3. The explosive assembly of claim 1, wherein the angular range is at least about 20 degrees.

4. The explosive assembly of claim 1, wherein the angular range is at most about 180 degrees.

5. The explosive assembly of claim 1, wherein the shield comprises a longitudinally extending member which wraps partially circumferentially about the explosive charges.

* * * * *